US011297427B2

(12) United States Patent
Fujii et al.

(10) Patent No.: US 11,297,427 B2
(45) Date of Patent: Apr. 5, 2022

(54) PROCESSING DEVICE, PROCESSING METHOD, AND PROGRAM FOR PROCESSING SOUND PICKUP SIGNALS

(71) Applicant: JVCKENWOOD CORPORATION, Yokohama (JP)

(72) Inventors: Yumi Fujii, Yokohama (JP); Hisako Murata, Yokohama (JP); Masaya Konishi, Yokohama (JP); Takahiro Gejo, Yokohama (JP); Kuniaki Takachi, Yokohama (JP)

(73) Assignee: JVCKENWOOD CORPORATION, Yokohama (JP)

( * ) Notice: Subject to any disclaimer, the term of this patent is extended or adjusted under 35 U.S.C. 154(b) by 0 days.

(21) Appl. No.: 17/016,674

(22) Filed: Sep. 10, 2020

(65) Prior Publication Data

US 2020/0413190 A1 Dec. 31, 2020

Related U.S. Application Data

(63) Continuation of application No. PCT/JP2019/009619, filed on Mar. 11, 2019.

(30) Foreign Application Priority Data

Mar. 22, 2018 (JP) ..... JP2018-53764

(51) Int. Cl.
*H04R 3/00* (2006.01)
*H04R 1/40* (2006.01)
*H04R 29/00* (2006.01)

(52) U.S. Cl.
CPC ..... *H04R 3/005* (2013.01); *H04R 1/406* (2013.01); *H04R 29/005* (2013.01); *H04R 2201/401* (2013.01)

(58) Field of Classification Search
CPC ..... H04R 3/005; H04R 1/406; H04R 29/005; H04R 2201/401
See application file for complete search history.

(56) References Cited

FOREIGN PATENT DOCUMENTS

| | | | |
|---|---|---|---|
| JP | H08-111899 | A | 4/1996 |
| JP | 2002-209300 | A | 7/2002 |
| JP | 2017-028365 | A | 2/2017 |

OTHER PUBLICATIONS

Fujii et al., Translation of JP2017028365A, 2017 (Year: 2017).*
Kageyama et al., Translation of JPH08111899A, 1996 (Year: 1996).*

* cited by examiner

*Primary Examiner* — Regina N Holder
(74) *Attorney, Agent, or Firm* — Procopio, Cory, Hargreaves & Savitch LLP

(57) ABSTRACT

A processing device according to an embodiment includes a sound pickup signal acquisition unit that acquires sound pickup signals picked up by left and right microphones through a monophonic input terminal, a switch unit that switches a connection state so that a first sound pickup signal picked up only by the left microphone and a second sound pickup signal picked up only by the right microphone are input, an interaural distance acquisition unit that acquires an interaural distance of the listener, a front time difference acquisition unit that acquires a front time difference, an incident time difference calculation unit that calculates an incident time difference based on an angle θ, the front time difference, and the interaural distance, and a transfer characteristics generation unit that calculates transfer characteristics by applying a delay corresponding to the incident time difference to the first and second sound pickup signals.

4 Claims, 10 Drawing Sheets

PROCESSING DEVICE, PROCESSING METHOD, AND PROGRAM FOR PROCESSING SOUND PICKUP SIGNALS

CROSS REFERENCE TO RELATED APPLICATION

This application is a Bypass Continuation of PCT/JP2019/009619, filed on Mar. 11, 2019, which is based upon and claims the benefit of priority from Japanese patent application No. 2018-53764 filed on Mar. 22, 2018, the disclosure of which is incorporated herein in its entirety by reference.

BACKGROUND

The present disclosure relates to a processing device, a processing method, and a program.

An out-of-head localization technique localizes sound images outside the head by canceling characteristics from headphones to ears and giving four characteristics from a stereo speaker to the ears. Patent Literature 1 (Japanese Unexamined Patent Application Publication No. 2002-209300) discloses a method using a head-related transfer function (HRTF) of a listener as a method for localizing sound images outside the head. Further, it is known that the HRTF varies widely from person to person, and particularly the variation of the HRTF due to a difference in auricle shape is significant.

Thus, it is preferred to measure spatial acoustic transfer characteristics (which are hereinafter referred to also as transfer characteristics) such as the HRTF in the state where a listener is wearing microphones on the left and right ears. With a recent increase in memory capacity and operation speed, it has become possible to perform audio signal processing such as localization by using a mobile terminal such as a smartphone or a tablet. This has enabled measurement and computation of the spatial acoustic transfer characteristics by use of a microphone terminal that comes with a mobile terminal.

In most mobile terminals, a microphone input terminal is for monophonic input, not stereo input. In some personal computers also, a microphone input terminal is for monophonic input. When measuring the spatial acoustic transfer characteristics from a speaker to the left and right ears by a mobile terminal or the like, if the distance from the speaker to the left and right ears is different, a difference (time difference) occurs in time needed for an acoustic signal to reach the left and right ears from the speaker. With a monophonic microphone input terminal, it is not possible to simultaneously record audio by microphones placed on the left and right ears, and therefore it is not possible to acquire a time difference. Thus, with a monophonic microphone input terminal, it has been difficult to obtain the spatial acoustic transfer characteristics that reflect a difference in time of arrival at the left and right ears.

A technique to solve the above problem is disclosed in Patent Literature 2 (Japanese Unexamined Patent Application Publication No. 2017-28365). Patent Literature 2 discloses a sound field reproduction device capable of appropriately measuring transfer characteristics even with monophonic microphone input. This sound field reproduction device includes a microphone unit having left and right microphones, a monophonic input terminal, and a switch unit for switching the output of the microphone unit.

By switching of the switch unit, a first sound pickup signal picked up only by the left microphone, a second sound pickup signal picked up only by the right microphone, and a third sound pickup signal picked up by the left and right microphones are measured. A processing device calculates a difference in time of arrival of a sound from a speaker at the left and right microphones. The processing device calculates transfer characteristics that reflect the time difference based on the first and second sound pickup signals. This enables acquisition of transfer characteristics in consideration of a time difference even with a monophonic input terminal.

SUMMARY

The out-of-head localization technique localizes sound images outside the head by giving four transfer characteristics from a stereo speaker to the ears. To perform the out-of-head localization technique, it is necessary to perform measurement where a speaker is placed ahead on the left of a listener and measurement where a speaker is placed ahead on the right of the listener. In Patent Literature 2, it is necessary to perform measurement three times in order to measure the first to third sound pickup signals for one speaker position. Thus, it is necessary to perform measurement six times in total in order to acquire the first to third sound pickup signals for each of the left and right speakers.

Further, there is a demand to perform measurement with different placement of a speaker with respect to a listener. For example, the feeling of localization that suits a listener's preference can be achieved by using transfer characteristics at a different opening angle with respect to the front direction of the listener. An increase in the number of placements causes an increase in the number of times of measurement.

A processing device according to an embodiment is a processing device for processing sound pickup signals obtained by picking up sound output from a sound source by left and right microphones worn on a listener, the device including a measurement signal generation unit configured to generate a measurement signal to be output from the sound source in order to perform characteristics measurement in a state where the sound source is placed in a direction at an angle θ from front of the listener, a monophonic input terminal configured to receive input of sound pickup signals picked up by the left and right microphones, a sound pickup signal acquisition unit configured to acquire the sound pickup signals picked up by the left and right microphones through the monophonic input terminal, a switch unit configured to switch a connection state so that each of a first sound pickup signal picked up only by the left microphone and a second sound pickup signal picked up only by the right microphone is input to the monophonic input terminal, an interaural distance acquisition unit configured to acquire an interaural distance of the listener, a front time difference acquisition unit configured to acquire, as a front time difference, a difference in time of arrival from the sound source placed in front of the listener to the left and right microphones, an incident time difference calculation unit configured to calculate an incident time difference based on the angle θ, the front time difference, and the interaural distance, and a transfer characteristics generation unit configured to calculate transfer characteristics from the sound source to the left and right microphones by applying a delay corresponding to the incident time difference to the first and second sound pickup signals acquired in the characteristics measurement.

A processing method according to an embodiment is a processing method in a processing device for processing sound pickup signals obtained by picking up sound output from a sound source by left and right microphones worn on a listener, where the processing device performs characteristics measurement by outputting a measurement signal to the sound source placed in a direction at an angle θ from front of the listener, the processing device has a monophonic input terminal, a switch unit is placed between the monophonic input terminal and the left and right microphones, and the switch unit switches input to the monophonic input terminal so that each of a first sound pickup signal picked up only by the left microphone and a second sound pickup signal picked up only by the right microphone is input to the monophonic input terminal, the processing method including a step of acquiring an interaural distance of the listener, a step of acquiring, as a front time difference, a difference in time of arrival from the sound source placed in front of the listener to the left and right microphones, a step of calculating an incident time difference based on the angle θ, the front time difference, and the interaural distance, and a step of calculating transfer characteristics from the sound source to the left and right microphones by applying a delay corresponding to the incident time difference to the first and second sound pickup signals acquired in the characteristics measurement.

A program according to an embodiment is a program causing a computer to execute a processing method for processing sound pickup signals obtained by picking up sound by left and right microphones, where the computer performs characteristics measurement by outputting a measurement signal to the sound source placed in a direction at an angle θ from front of the listener, the computer has a monophonic input terminal, a switch unit is placed between the monophonic input terminal and the left and right microphones, and the switch unit switches input to the monophonic input terminal so that each of a first sound pickup signal picked up only by the left microphone and a second sound pickup signal picked up only by the right microphone is input to the monophonic input terminal, the processing method including a step of acquiring an interaural distance of the listener, a step of acquiring, as a front time difference, a difference in time of arrival from the sound source placed in front of the listener to the left and right microphones, a step of calculating an incident time difference based on the angle θ, the front time difference, and the interaural distance, and a step of calculating transfer characteristics from the sound source to the left and right microphones by applying a delay corresponding to the incident time difference to the first and second sound pickup signals acquired in the characteristics measurement.

According to the present disclosure, there are provided a processing device, a processing method and a program capable of measuring transfer characteristics in a simplified way.

DETAILED DESCRIPTION

The overview of a sound localization process using a filter generated by a processing device according to an embodiment is described hereinafter. An out-of-head localization process according to this embodiment performs out-of-head localization by using spatial acoustic transfer characteristics and ear canal transfer characteristics. The spatial acoustic transfer characteristics are transfer characteristics from a sound source such as a speaker to the ear canal. The ear canal transfer characteristics are transfer characteristics from a speaker unit such as headphones or earphones to the eardrum. In this embodiment, out-of-head localization is implemented by measuring the spatial sound transfer characteristics when headphones or earphones are not worn and using the measurement data.

Out-of-head localization according to this embodiment is performed by a user terminal such as a personal computer, a smart phone, or a tablet PC. The user terminal is an information processor including a processing means such as a processor, a storage means such as a memory or a hard disk, a display means such as a liquid crystal monitor, and an operating means such as a touch panel, a button, a keyboard and a mouse. The user terminal may have a communication function to transmit and receive data. Further, an output means (output unit) with headphones or earphones is connected to the user terminal. As an out-of-head localization device, a general-purpose processing device having a monophonic input terminal may be used.

First Embodiment (Out-of-Head Localization Device)

Figure 1:
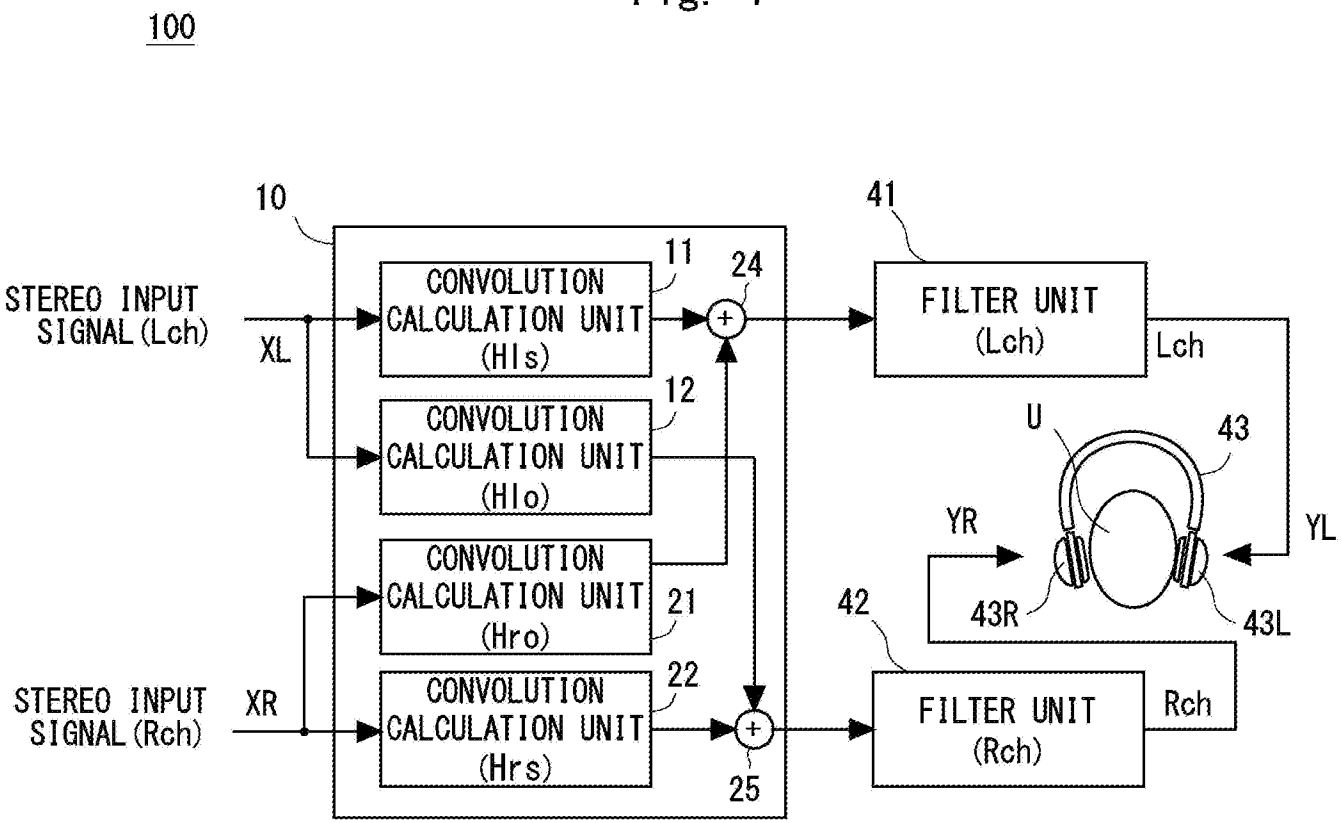
FIG. 1 is a block diagram showing an out-of-head localization device according to an embodiment.

FIG. 1 shows an out-of-head localization device 100, which is an example of a sound field reproduction device according to this embodiment. FIG. 1 is a block diagram of the out-of-head localization device 100. The out-of-head localization device 100 reproduces sound fields for a listener U who is wearing headphones 43. Thus, the out-of-head localization device 100 performs sound localization for L-ch and R-ch stereo input signals XL and XR. The L-ch and R-ch stereo input signals XL and XR are analog audio reproduced signals that are output from a CD (Compact Disc) player or the like or digital audio data such as mp3 (MPEG Audio Layer-3). Note that the out-of-head localization device 100 is not limited to a physically single device, and a part of processing may be performed in a different device. For example, a part of processing may be performed by an information processor such as a smartphone, and the rest of processing may be performed by a DSP (Digital Signal Processor) included in the headphones 43 or the like.

The out-of-head localization device 100 includes an out-of-head localization unit 10, a filter unit 41, a filter unit 42, and headphones 43. The out-of-head localization unit 10, the filter unit 41 and the filter unit 42 can be implemented by a processor or the like, to be specific.

The out-of-head localization unit 10 includes convolution calculation units 11 to 12 and 21 to 22, and adders 24 and 25. The convolution calculation units 11 to 12 and 21 to 22 perform convolution processing using the spatial acoustic transfer characteristics. The stereo input signals XL and XR from a CD player or the like are input to the out-of-head localization unit 10. The spatial acoustic transfer characteristics are set to the out-of-head localization unit 10. The out-of-head localization unit 10 convolves a filter of the spatial acoustic transfer characteristics (which is referred hereinafter also as a spatial acoustic filter) into each of the stereo input signals XL and XR having the respective channels. The spatial acoustic transfer characteristics may be a head-related transfer function HRTF measured in the head or auricle of a measured person, or may be the head-related transfer function of a dummy head or a third person.

The spatial acoustic transfer characteristics are a set of four spatial acoustic transfer characteristics Hls, Hlo, Hro and Hrs. Data used for convolution in the convolution calculation units 11 to 12 and 21 to 22 is a spatial acoustic filter. The spatial acoustic filter is generated by cutting out the spatial acoustic transfer characteristics Hls, Hlo, Hro and Hrs with a specified filter length.

Each of the spatial acoustic transfer characteristics Hls, Hlo, Hro and Hrs is acquired in advance by impulse response measurement or the like. For example, the listener U wears microphones on the left and right ears, respectively. Left and right speakers placed ahead of the listener U output impulse sounds for performing impulse response measurement. Then, the microphones pick up measurement signals such as the impulse sounds output from the speakers. The spatial acoustic transfer characteristics Hls, Hlo, Hro and Hrs are acquired based on sound pickup signals in the microphones. The spatial acoustic transfer characteristics Hls between the left speaker and the left microphone, the spatial acoustic transfer characteristics Hlo between the left speaker and the right microphone, the spatial acoustic transfer characteristics Hro between the right speaker and the left microphone, and the spatial acoustic transfer characteristics Hrs between the right speaker and the right microphone are measured.

The convolution calculation unit 11 then convolves the spatial acoustic filter in accordance with the spatial acoustic transfer characteristics Hls to the L-ch stereo input signal XL. The convolution calculation unit 11 outputs convolution calculation data to the adder 24. The convolution calculation unit 21 convolves the spatial acoustic filter in accordance with the spatial acoustic transfer characteristics Hro to the R-ch stereo input signal XR. The convolution calculation unit 21 outputs convolution calculation data to the adder 24. The adder 24 adds the two convolution calculation data and outputs the data to the filter unit 41.

The convolution calculation unit 12 convolves the spatial acoustic filter in accordance with the spatial acoustic transfer characteristics Hlo to the L-ch stereo input signal XL. The convolution calculation unit 12 outputs convolution calculation data to the adder 25. The convolution calculation unit 22 convolves the spatial acoustic filter in accordance with the spatial acoustic transfer characteristics Hrs to the R-ch stereo input signal XR. The convolution calculation unit 22 outputs convolution calculation data to the adder 25. The adder 25 adds the two convolution calculation data and outputs the data to the filter unit 42.

An inverse filter that cancels out the headphone characteristics (characteristics between a reproduction unit of headphones and a microphone) is set to the filter units 41 and 42. Then, the inverse filter is convolved to the reproduced signals (convolution calculation signals) on which processing in the out-of-head localization unit 10 has been performed. The filter unit 41 convolves the inverse filter to the L-ch signal from the adder 24. Likewise, the filter unit 42 convolves the inverse filter to the R-ch signal from the adder 25. The inverse filter cancels out the characteristics from the headphone unit to the microphone when the headphones 43 are worn. The microphone may be placed at any position between the entrance of the ear canal and the eardrum. The inverse filter may be calculated from a result of measuring the characteristics of the listener U, or may be measured on another listener or a dummy head.

The filter unit 41 outputs a processed L-ch signal to a left unit 43L of the headphones 43. The filter unit 42 outputs a processed R-ch signal to a right unit 43R of the headphones 43. The user U is wearing the headphones 43. The headphones 43 output the L-ch signal and the R-ch signal toward the user U. It is thereby possible to reproduce sound images localized outside the head of the user U.

As described above, the out-of-head localization device 100 performs out-of-head localization by using the spatial acoustic filters in accordance with the spatial acoustic transfer characteristics Hls, Hlo, Hro and Hrs and the inverse filters of the headphone characteristics. In the following description, the spatial acoustic filters in accordance with the spatial acoustic transfer characteristics Hls, Hlo, Hro and Hrs and the inverse filter of the headphone characteristics are referred to collectively as an out-of-head localization filter. In the case of 2ch stereo reproduced signals, the out-of-head localization filter is composed of four spatial acoustic filters and two inverse filters. The out-of-head localization device 100 then carries out convolution calculation on the stereo reproduced signals by using the total six out-of-head localization filters and thereby performs out-of-head localization.

A measurement device that measures the spatial acoustic transfer characteristics is described hereinafter with reference to FIG. 2. A measurement device 200 includes a microphone unit 2, a stereo speaker 5, a processing device 210, and a switch unit 7. The processing device 210 includes a monophonic input terminal 8 and an audio output terminal 9. The switch 7 includes a switch 7*a* and an adder 7*b*.

The processing device 210 is an information processor such as a personal computer, a smartphone or a tablet PC. The processing device 210 performs measurement by executing a program stored in a memory 61 or the like. The processing device 210 includes the memory 61 that stores sound pickup signals, an operating unit 62 that receives an operation of the listener U, and a processing unit 63 that processes each signal. The operating unit 62 is a touch panel, for example.

To be specific, the processing device 210 executes an application program (app), and thereby generates an impulse signal and starts measurement of the transfer characteristics. Note that the processing device 210 may be the same device as or a different device from the out-of-head localization device 100 shown in FIG. 1. When the processing device 210 and the out-of-head localization device 100 are the same device, the processing device 210 stores the measured transfer characteristics into the memory 61 or the like. When, on the other hand, the processing device 210 and the out-of-head localization device 100 are different devices, the processing device 210 transmits the transfer characteristics (transfer function) to the out-of-head localization device 100 by wired or wireless communication. Note that a signal for measurement is not limited to the impulse signal, and another signal such as a TSP (Time Stretched Pulse) signal or an M-sequence signal may be used.

Figure 2:
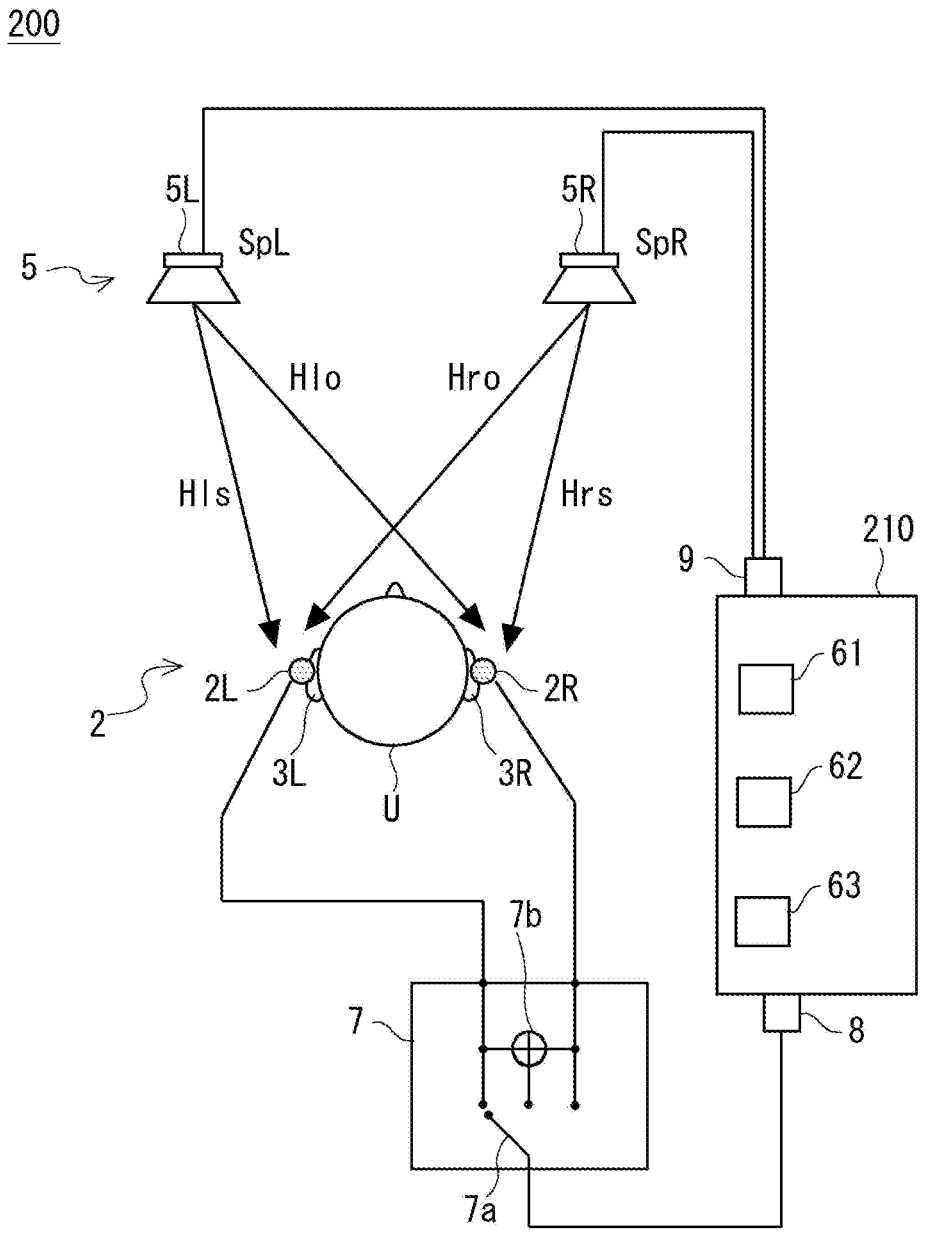
FIG. 2 is a view showing a configuration for measuring transfer characteristics.

In FIG. 2, a left speaker 5L and a right speaker 5R are placed ahead of the listener U. The left speaker 5L and the right speaker 5R are arranged bilaterally symmetric. The stereo speaker 5 that includes the left speaker 5L and the right speaker 5R is connected to the processing device 210 through the audio output terminal 9. Although the audio output terminal 9 is connected to the left speaker 5L and the right speaker 5R because it is a stereo output terminal, the audio output terminal 9 may be a monophonic input terminal. In this case, the audio output terminal 9 is connected to one speaker. Then, this speaker is shifted from a position that is ahead on the left of the listener U (i.e., a position of the left speaker 5L in FIG. 2) to a position that is ahead on the right of the listener U (i.e., a position of the right speaker 5R in FIG. 2), so that the transfer characteristics from the left speaker and the transfer characteristics from the right speaker can be measured.

Further, the monophonic input terminal 8 and the audio output terminal 9 may be a common input/output terminal. In this case, a sound can be input and output by connecting a 3-prong or 4-prong plug. Further, the processing device 210 may output a measurement signal to the stereo speaker 5 by wireless communication such as Bluetooth (registered trademark).

The processing device 210 generates an impulse signal to be output from each of the left speaker 5L and the right speaker 5R. Specifically, the measurement device 200 measures each of the transfer characteristics Hls from the left speaker 5L to a left microphone 2L and the transfer characteristics Hlo from the right speaker 5R to a right microphone 2R. Note that, although the left speaker 5L is placed ahead on the left of the listener U, and the right speaker 5R is placed ahead on the right of the listener U in FIG. 2, the placement of speakers may be arbitrary, and it is not limited thereto. Further, the number of speakers placed may be 1, or 2 or more.

Further, the microphone 2L for sound pickup is placed at the entrance of the ear canal or the eardrum position of a left ear 3L of the listener U. A microphone 2R for sound pickup is placed at the entrance of the ear canal or the eardrum position of a right ear 3R of the listener U. Note that the listener U may be a person or a dummy head. Thus, in this embodiment, the user U is a concept that includes not only a person but also a dummy head. The microphone unit 2 that includes the left microphone 2L and the right microphone 2R is connected to the switch unit 7. Note that the switch unit 7 may be included in the microphone unit 2.

The switch unit 7 is connected to the monophonic input terminal 8 on the processing device 210 through a cable. Thus, the left microphone 2L and the right microphone 2R are connected to the monophonic input terminal 8 through the switch unit 7. Further, the microphone unit 2 is connected to the processing device 210 through the monophonic input terminal 8. Thus, the sound pickup signal picked up by the microphone unit 2 is input to the processing device 210 through the switch unit 7 and the monophonic input terminal 8.

The switch unit 7 switches the output of the microphone unit 2 so that a sound pickup signal picked up by one or both of the left and right microphones 2L and 2R is input to the monophonic input terminal 8. The adder 7*b* adds a signal from the left microphone 2L and a signal from the right microphone 2R. The switch 7*a* switches the output of only the left microphone 2L, the output of only the right microphone 2R, and the output from the adder 7*b*. The control of the switch unit 7 may be done by the processing device 210 or by the listener U.

The listener U or the processing unit 63 controls the switch 7*a*, and thereby the connection state is switched. The state where the switch 7*a* is connected to the left microphone 2L is referred to as a first connection state. The state where the switch 7*a* is connected to the right microphone 2R is referred to as a second connection state. The state where the switch 7*a* is connected to the adder 7*b* is referred to as a third connection state. In the first to third states, the microphone unit 2 picks up the sound generated by the speaker. A signal picked up in the first connection state is referred to as a first sound pickup signal sL. A signal picked up in the second connection state is referred to as a second sound pickup signal sR. A signal picked up in the third connection state is referred to as a third sound pickup signal sC.

A signal picked up only by the left microphone 2L is the first sound pickup signal sL. A signal picked up only by the right microphone 2R is the second sound pickup signal sR. A signal obtained by adding two signals picked up by the left and right microphones 2L and 2R is the third sound pickup signal sC. The third sound pickup signal sC is a signal where the first sound pickup signal sL and the second sound pickup signal sR are superimposed on one another.

Figure 3:
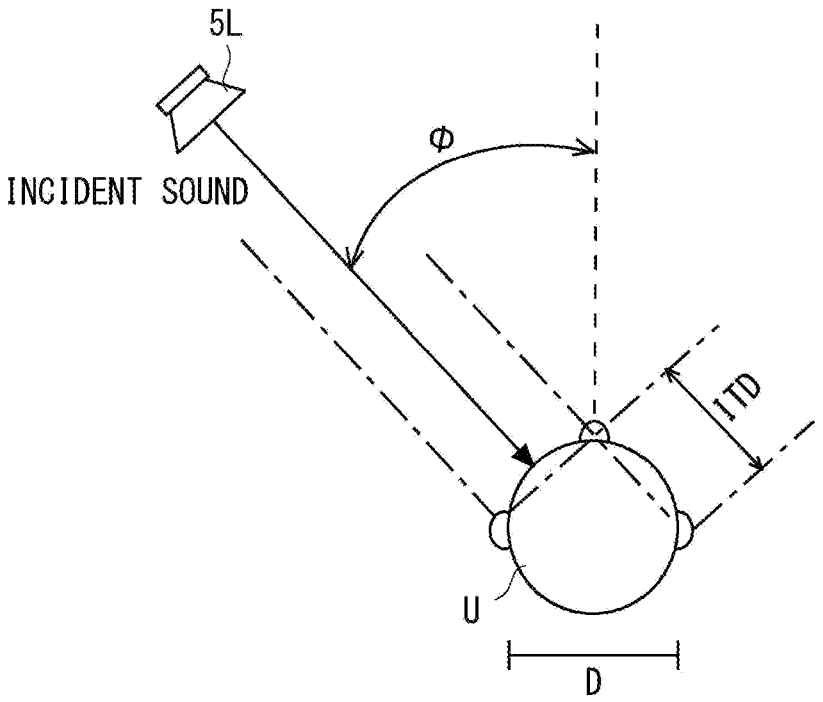
FIG. 3 is a view illustrating an incident angle φ of a speaker and an interaural time difference (ITD).

When viewed from above, the angle of an incident sound relative to the front of the user U is an incident angle φ (see FIG. 3). The incident angle φ is an opening angle when the front direction of the user U is 0° in the horizontal plane, and it ranges from 0° to 90°. Processing of calculating the transfer characteristics Hls and Hlo when the incident angle φ is an arbitrary angle θ is described hereinbelow.

Figure 4:
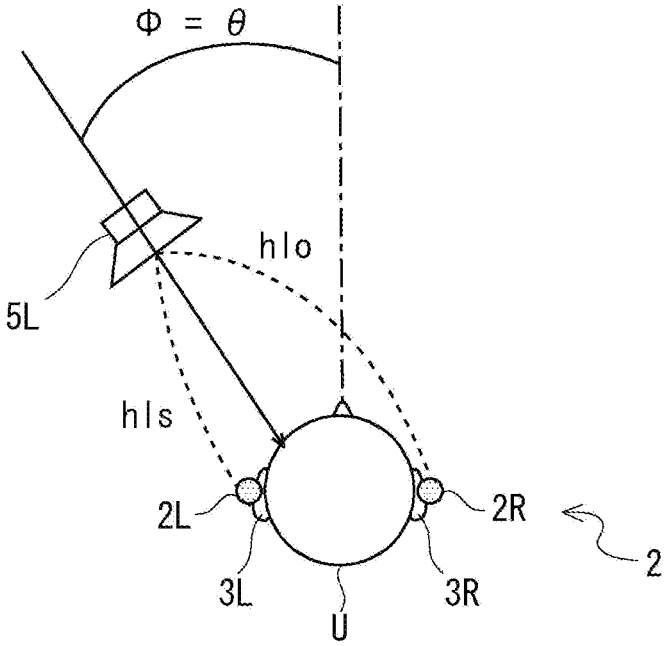
FIG. 4 is a top view schematically showing a configuration in characteristics measurement.

As shown in FIG. 4, measurement in the state where the speaker 5L is placed at a position with the angle θ is referred to as characteristics measurement. In the characteristics measurement, the left speaker 5L reproduces the impulse signal. The processing device 210 switches the switch unit 7 and measures the sound pickup signal. Specifically, the switch unit 7 switches the output of the microphone unit 2 and performs measurement of the transfer characteristics two times by using the impulse signal from the left speaker 5L. The processing device 210 thereby records the first and second sound pickup signals for the impulse signal from the left speaker 5L.

Further, the processing device 210 calculates a time difference ITD in time for the sound from the speaker to reach the left and right ears (see FIG. 3). To be specific, when time for the impulse signal from the left speaker 5L to reach the left microphone 2L is tL, and time for the impulse signal from the right speaker 5R to reach the right microphone 2R is tR, the time difference ITD is calculated as a difference between tL and tR (tL−tR). However, since the first sound pickup signal sL and the second sound pickup signal sR are picked up separately, it is difficult to accurately obtain the time difference ITD only from the first sound pickup signal sL and the second sound pickup signal sR.

Thus, the processing device 210 calculates a time difference ITDθ (which is hereinafter referred to also as an incident time difference ITDθ) when the speaker is placed at an arbitrary angle θ based on the angle θ, a front time difference ITD0, and an interaural distance D. It is thereby possible to accurately obtain the transfer characteristics Hls and Hlo without measuring the third sound pickup signal in the characteristics measurement where the speaker is placed in the direction of the angle θ.

Note that the interaural distance D is the distance from the left ear to the right ear of the listener U (see FIG. 3). The front time difference ITD0 is acquired by front measurement where the speaker is placed in front of the listener U. The front time difference ITD0 is described later.

The same measurement is performed also for the right speaker 5R, and thereby the processing device 210 records the first and second sound pickup signals for the right speaker 5R. The processing device 210 obtains the transfer characteristics HRo and HRs based on the first and second sound pickup signals for the right speaker 5R.

This embodiment eliminates the need to acquire the third sound pickup signal in the state where the speakers 5L and 5R are placed at the angle θ. This enables measurement of the transfer characteristics with a smaller number of times of sound pickup compared with Patent Literature 2. For example, in the case of measuring a plurality of sets of the transfer characteristics Hls, Hlo, HRo and HRs with different placements of the speakers 5L and 5R, an increase in the number of times of sound pickup is reduced.

Figure 5:
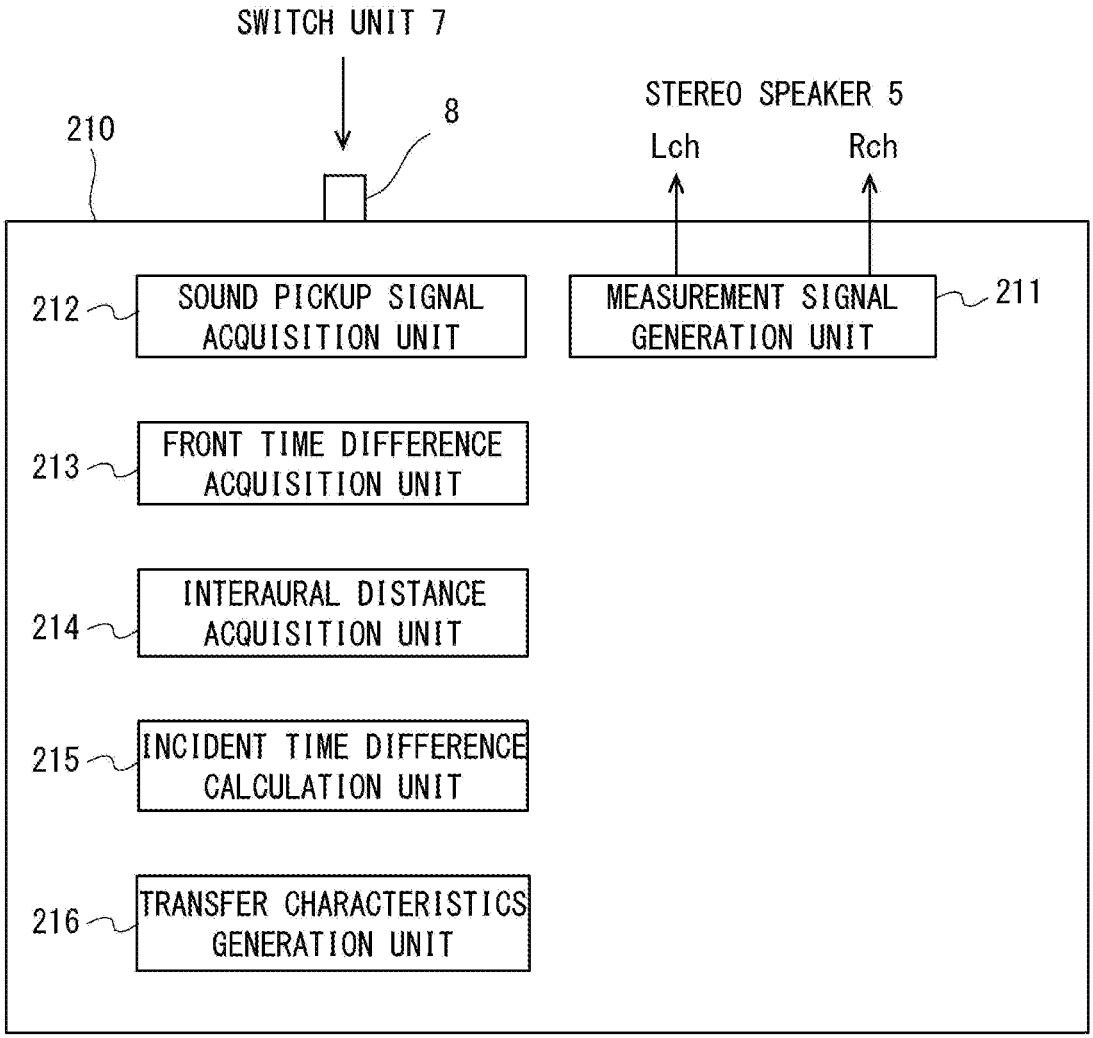
FIG. 5 is a block diagram showing a processing device for measuring transfer characteristics.

The above-described processing is described hereinafter in detail with reference to FIG. 5. FIG. 5 is a control block diagram showing the configuration of the processing device 210. The processing device 210 includes a measurement signal generation unit 211, a sound pickup signal acquisition unit 212, a front time difference acquisition unit 213, an interaural distance acquisition unit 214, an incident time difference calculation unit 215, and a transfer characteristics generation unit 216. Although processing in the case of using the left speaker 5L is described below, the same applies to processing in the case of using the right speaker 5R, and the description thereof is omitted as appropriate.

As described above, the processing device 210 is an information processor having the monophonic input terminal 8, and it includes the memory 61, the operating unit 62 and the processing unit 63 (see also FIG. 2). The memory 61 stores a processing program, parameters, measurement data and the like. The processing unit 63 includes a processor such as a CPU (Central Processing Unit), and it executes the processing program stored in the memory 61. As a result that the processing unit 63 executes the processing program, each processing in the measurement signal generation unit 211, the sound pickup signal acquisition unit 212, the front time difference acquisition unit 213, the interaural distance acquisition unit 214, the incident time difference calculation unit 215, and the transfer characteristics generation unit 216 is performed.

The measurement signal generation unit 211 generates a measurement signal. The measurement signal generated by the measurement signal generation unit 211 is converted from digital to analog by a D/A converter (not shown) and output to the left speaker 5L. The measurement signal may be the impulse signal, the TSP signal or the like. The measurement signal contains a measurement sound such as an impulse sound.

The sound pickup signal acquisition unit 212 acquires sound pickup signals from the left microphone 2L and the right microphone 2R. The sound pickup signals from the microphones 2L and 2R are converted from analog to digital by A/D converters (not shown) and input to the sound pickup signal acquisition unit 212. The sound pickup signal acquisition unit 212 may perform synchronous addition of signals obtained by a plurality of times of measurement. Further, the switch unit 7 switches the input to the monophonic input terminal 8 from the speaker 5L. The sound pickup signal acquisition unit 212 acquires each of the first to third sound pickup signals.

Figure 6:
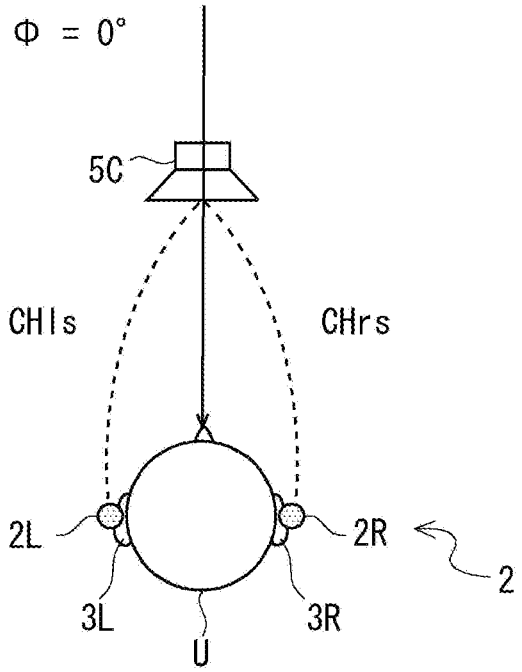
FIG. 6 is a top view schematically showing a configuration in front measurement.
Figure 7:
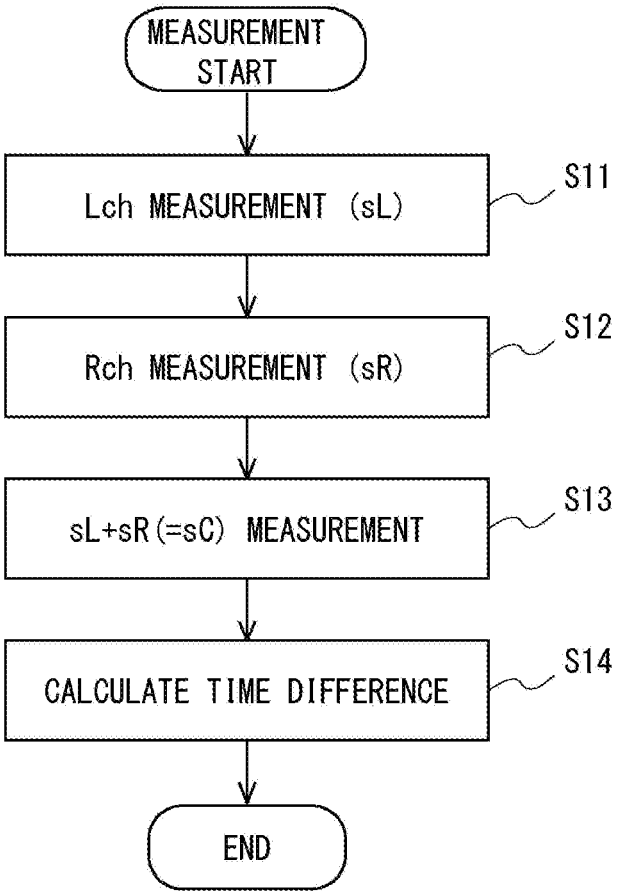
FIG. 7 is a flowchart showing a process for calculating a time difference.

The front time difference acquisition unit 213 acquires the front time difference ITD0 of the listener U. Front measurement for acquiring the front time difference ITD0 is described hereinafter with reference to FIGS. 6 and 7. FIG. 6 is a top view schematically showing a configuration of the front measurement for acquiring the front time difference ITD0. FIG. 7 is a flowchart showing a process for the front measurement.

In the front measurement, a speaker is placed in the middle of left and right, and it is shown as a speaker 5C as in FIG. 6. In FIG. 6, the speaker 5C is placed straight in front of the listener U. The center of left and right of the speaker 5C coincides with the center of left and right the listener U. The incident angle is φ=0°.

If the shape of a face or ears is completely bilaterally symmetric, the time of arrival from the speaker 5C placed straight in front of the left ear 3L to the left ear 3L and the time of arrival from the speaker 5C to the right ear 3R are supposed to be the same. In practice, however, a slight difference in distance arises due to a difference in head or auricle shape, which causes the front time difference ITD0 to occur. Thus, the front time difference ITD0 is a time difference caused by the reflection and diffraction of the face or ear shape of the individual listener U.

The processing device 210 performs measurement of an Lch signal that is input to the microphone 2L (S11). To be specific, the switch unit 7 is switched into the first connection state, and the measurement signal generation unit 211 causes the speaker 5C to output an impulse signal. The sound pickup signal acquisition unit 212 then picks up the first sound pickup signal sL. The first sound pickup signal sL corresponds to transfer characteristics CHls from the speaker 5C to the left ear 3L (microphone 2L). The processing device 210 stores data of the first sound pickup signal sL into the memory 61 or the like.

Next, the processing device 210 performs measurement of an Rch signal that is input to the microphone 2R (S12). To be specific, the switch unit 7 is switched into the second connection state, and the measurement signal generation unit 211 causes the speaker 5C to output an impulse signal. The sound pickup signal acquisition unit 212 then picks up the second sound pickup signal sR. The second sound pickup signal sR corresponds to transfer characteristics CHrs from the speaker 5C to the right ear 3R (microphone 2R). The processing device 210 stores data of the second sound pickup signal sR into the memory 61 or the like.

Further, the processing device 210 performs measurement of a signal where the Lch signal that is input to the microphone 2L and the Rch signal that is input to the microphone 2R are added together (S13). To be specific, the switch unit 7 is switched into the third connection state, and the measurement signal generation unit 211 causes the left speaker 5L to output an impulse signal. The sound pickup signal acquisition unit 212 then picks up the third sound pickup signal sC(=sL+sR). The processing device 210 stores data of the third sound pickup signal sC into the memory 61 or the like. Note that the order of measuring the first to third sound pickup signals is not particularly limited. S11 to S13 are performed in the state where the speaker 5C is placed in front of the listener U.

Based on the first to third sound pickup signals, the front time difference acquisition unit 213 calculates a time difference (the front time difference ITDθ) for a sound from the speaker 5C to reach the left and right microphones 2L and 2R (S14). The front time difference acquisition unit 213 calculates a signal where a delay time dt is added between the first sound pickup signal sL and the second sound pickup signal sR as an addition signal y. The front time difference acquisition unit 213 calculates a cross-correlation function of the addition signal y and the third sound pickup signal sC. When the measurement time (filter length) of the sound pickup signal is Lf and the delay time dt is varied from −Lf to Lf, the delay time dt when the cross-correlation function is greatest is the front time difference ITD0.

In the front measurement, it is unknown which of the first sound pickup signal sL and the second sound pickup signal sR delays, and it is thereby necessary to calculate the addition signal y in both of the cases where a delay is applied to the first sound pickup signal sL and where a delay is applied to the second sound pickup signal sR. In other words, the cross-correlation function is calculated for the case where the first sound pickup signal sL delays behind the second sound pickup signal sR and the case where the second sound pickup signal sR delays behind the first sound pickup signal sL. Therefore, the range of the delay time is from −Lf to +Lf. Further, with the delay time t=0, the timing of appearance of the first sound pickup signal sL and the second sound pickup signal sR (i.e., the timing of a direct sound that first reaches the ear) coincides.

Figure 8:
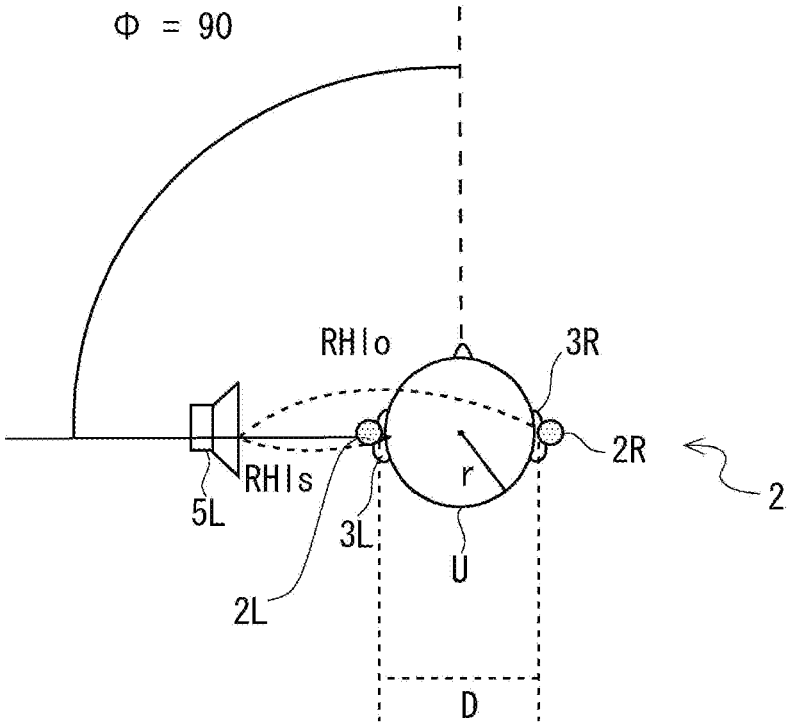
FIG. 8 is a top view schematically showing a configuration in lateral measurement.

Referring back to FIG. 5, the interaural distance acquisition unit 214 acquires the interaural distance D. The interaural distance D can be acquired by lateral measurement, for example. A configuration for the lateral measurement is shown in FIG. 8. In the lateral measurement, the speaker 5L is placed just beside the listener U. Thus, the incident angle is $\varphi=90°$.

In the lateral measurement shown in FIG. 8, the time of arrival from the left speaker 5L to the left ear 3L is shorter than the time of arrival from the left speaker 5L to the left ear 3L. To be specific, a sound reaches the left ear 3L earlier by time corresponding to the width of the head of the listener U. Further, since the time difference ITD is greatest at $\varphi=90°=\pi/2$[rad], a time difference calculated in the lateral measurement is referred to as a maximum time difference ITDmax. The interaural distance acquisition unit 214 calculates the interaural distance D (i.e., the width of the head) based on this maximum time difference ITDmax.

The interaural distance acquisition unit 214 calculates the maximum time difference ITDmax by using the first sound pickup signal sL, the second sound pickup signal sR and the third sound pickup signal sC in the lateral measurement. To be specific, the interaural distance acquisition unit 214 calculates the maximum time difference ITDmax according to the flowchart shown in FIG. 7. The sound pickup signal acquisition unit 212 acquires the first to third sound pickup signals by a similar technique to the one used for the front time difference ITD0. The first sound pickup signal sL corresponds to transfer characteristics Rhls, and the second sound pickup signal sR corresponds to transfer characteristics Rhlo.

Just like in S14 of FIG. 7, the interaural distance acquisition unit 214 calculates the time difference ITD. The interaural distance acquisition unit 214 calculates a signal where a delay time dt is added between the first sound pickup signal sL and the second sound pickup signal sR as an addition signal y. Then, the interaural distance acquisition unit 214 calculates a cross-correlation function of the addition signal y and the third sound pickup signal sC. When the measurement time (filter length) of each sound pickup signal is Lf and the delay time dt is varied from 0 to Lf, the delay time dt when the cross-correlation function is greatest is the maximum time difference ITDmax.

In the lateral measurement, it is apparent that the second sound pickup signal sR delays behind the first sound pickup signal sL, and therefore a delay is applied only to the second sound pickup signal sR. Therefore, the range of the delay time is from 0 to +Lf. Further, with the delay time t=0, the timing of appearance of the first sound pickup signal sL and the second sound pickup signal sR (i.e., the timing of a direct sound that reaches the ear) coincides.

Next, the interaural distance acquisition unit 214 calculates the interaural distance D from the maximum time difference ITDmax. Using an interaural time difference model, which is described later, a relational expression of the interaural distance D and the time difference ITD is the following expression (1).

$$\varphi+\sin\varphi=2c\times ITD/D \tag{1}$$

In the above expression, φ is the incident angle [rad], c is the acoustic velocity, and D is the interaural difference. The expression (1) uses an interaural time difference model where a sound channel length from the nose to the cheek of the listener U is approximated by a straight line, and a sound channel length from the cheek to the ear is approximated by a circular arc. As shown in the approximate expression of the expression (1), the interaural time difference ITD varies depending on the incident angle φ and the interaural distance D.

When the shape of the head when viewed from above is a circle with a radius r and the interaural distance D=a radius 2*r*, the following expression (2) is obtained from the expression (1).

$$ITD=r(\varphi+\sin\varphi)/c \tag{2}$$

It is assumed that c=340 m/sec. Since $\varphi=\pi/2(=90°$ in the lateral measurement, the interaural distance D is obtained by substituting $\pi/2$ for φ and ITD=ITDmax. In this manner, the interaural distance D is obtained by applying the time difference ITDmax to the interaural time difference model. Note that the lateral measurement is not limited to $\varphi=90°$. The interaural distance D can be calculated from the expression (1) also when φ is an arbitrary value.

Referring back to FIG. 5, the incident time difference calculation unit 215 calculates a time difference at the incident angle $\varphi=\theta$ as the incident time difference ITDθ. The incident time difference calculation unit 215 estimates an estimated time difference by applying the angle θ and the interaural distance D to the interaural time difference model. Further, the incident time difference calculation unit 215 adds the front time difference to the estimated time difference and thereby calculates the incident time difference ITDθ.

To be specific, the incident time difference calculation unit 215 estimates the estimated time difference with $\varphi=\theta$ [rad] in the calculating formula of the expression (1) derived from the interaural time difference model. Specifically, the incident time difference calculation unit 215 calculates the time difference ITD when $\varphi=\theta/(2\pi)$[rad] in the above expression (1) as the estimated time difference. Further, the incident time difference calculation unit 215 adds the front time difference ITD0 to the estimated time difference and thereby obtains the incident time difference ITDθ. The incident time difference ITDθ that is most appropriate for the listener U is obtained in this manner.

The transfer characteristics generation unit 216 applies a delay corresponding to the incident time difference ITDθ between the first sound pickup signal sL and the second sound pickup signal sR picked up in the characteristics measurement and thereby generates the transfer characteristics Hls and Hlo. The characteristics measurement is performed in the state where the speaker 5L is placed in the direction at the angle θ as shown in FIG. 4.

To be specific, from the state where the timing of appearance of the first sound pickup signal sL and the second sound pickup signal sR coincides, the transfer characteristics generation unit 216 delays the second sound pickup signal sR by the incident time difference ITDθ. Then, the transfer characteristics generation unit 216 acquires the transfer characteristics Hls based on the first sound pickup signal sL, and acquires the transfer characteristics Hlo based on the second sound pickup signal sR to which the delay time has been applied. Further, the transfer characteristics Hls and Hlo may be calculated by cutting out the transfer characteristics with a specified filter length.

The same processing is performed for the Rch speaker. To be specific, the characteristics measurement is performed by using the right speaker 5R placed in the position ahead on the right of the listener U at the angle θ. Just like in the processing for the left speaker 5L, the incident time difference calculation unit 215 calculates the incident time difference ITDθ based on the angle θ, the interaural distance D and the front time difference ITD0. Note that the interaural distance D and the front time difference ITD0 can be common to the left and right transfer characteristics.

From the state where the timing of appearance of the first sound pickup signal sL and the second sound pickup signal sR coincides, the transfer characteristics generation unit 216 delays the first sound pickup signal sL by the incident time difference ITDθ. The transfer characteristics generation unit 216 acquires the transfer characteristics Hro based on the first sound pickup signal sL to which the delay time has been applied, and acquires the transfer characteristics Hrs based on the second sound pickup signal sR. Further, the transfer characteristics Hrs and Hro may be calculated by cutting out the transfer characteristics with a specified filter length. In this manner, one set of the transfer characteristics Hls, Hlo, Hrs and Hro to be used for out-of-head localization are acquired. The out-of-head localization device 100 shown in FIG. 1 performs out-of-head localization by using the transfer characteristics Hls, Hlo, Hrs and Hro.

As described above, the values of the interaural distance D and the front time difference ITD0 may be common between the transfer characteristics Hls and Hlo and the transfer characteristics HRo and HRs. Thus, the lateral measurement for acquiring the interaural distance D is performed only once for one listener U. Likewise, the front measurement for acquiring the front time difference ITD0 is performed only once for one listener U.

As described above, the processing device 210 acquires the first to third sound pickup signals in the front measurement and the lateral measurement, and acquires the first and second pickup signals in the characteristics measurement. Thus, when there is a need to increase the number of transfer characteristics, which is, when there is a need to place speakers in various places and measure transfer characteristics, the total number of times of sound pickup is reduced compared with Patent Literature 2.

To be specific, when the number of placements of speakers is N, it is necessary to pick up (3N) number of sound pickup signals in Patent Literature 2 because the first to third sound pickup signals are measured at each placement. On the other hand, since there is no need to perform the front measurement and the lateral measurement for both of left and right speakers, it is necessary to pick up only (2N+6) number of sound pickup signals in this embodiment. This allows transfer characteristics to be measured in a simplified way even when the number of placements of speakers is increased.

In this embodiment, the incident time difference ITDθ is calculated by using the front time difference ITD0 obtained in the front measurement. Since the front time difference ITD0 has a value that reflects the shape of the face or auricle of the listener U as described above, the transfer characteristics are calculated more accurately. Further, since the interaural distance D measured for the listener U and the first and second sound pickup signals are used, the transfer characteristics that reflect the shape of the face or auricle of the listener U are obtained. This enables out-of-head localization suitable for the listener U to be performed.

This embodiment reduces the number of times of sound pickup, which allows reduction of errors due to measurement. For example, if the number of times of sound pickup increases, there is a possibility that the posture of the listener U changes during measurement. The change of the posture of the listener U causes a failure to acquire appropriate transfer characteristics. In this embodiment, the number of times of sound pickup is reduced, which allows reduction of measurement time. This allows reduction of errors due to measurement.

Figure 9:
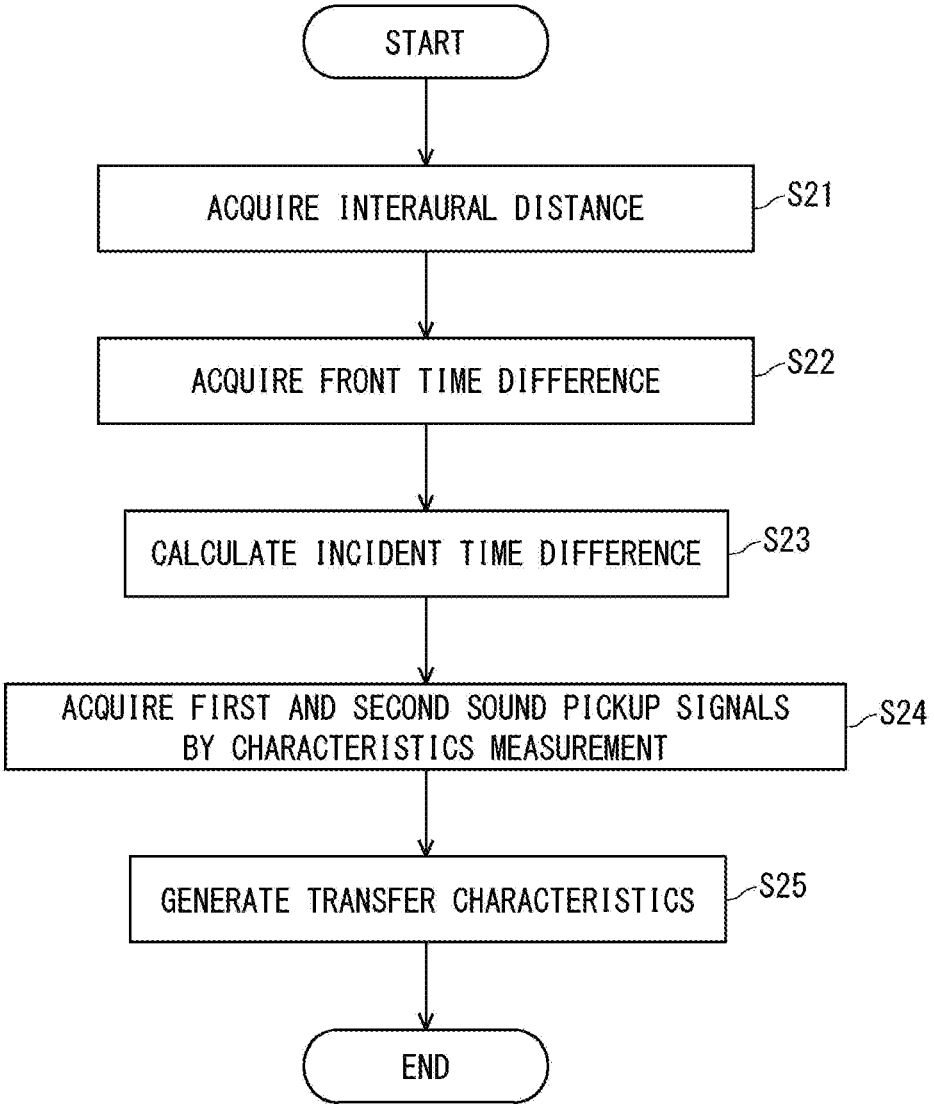
FIG. 9 is a flowchart showing a processing method according to the embodiment.

A processing method according to this embodiment is described hereinafter with reference to FIG. 9. FIG. 9 is a flowchart showing a processing method according to this embodiment. Note that the description of those described above is omitted as appropriate.

The interaural distance acquisition unit 214 acquires the interaural distance D (S21). To be specific, the lateral measurement is performed in the speaker placement shown in FIG. 8. The interaural distance acquisition unit 214 calculates the interaural distance D based on the first to third sound pickup signals obtained in the lateral measurement. The lateral measurement is not necessarily performed with φ=90°, and it may be performed in the state where φ is an arbitrary angle.

The interaural distance D may be acquired by measurement other than the lateral measurement. For example, the interaural distance D may be obtained from a camera image. A camera of the processing device 210 takes an image of the head of the listener U. The processing unit 63 may calculate the interaural distance D by image processing.

Alternatively, the listener U or another person may measure the interaural distance D by using measuring equipment such as a scale. In this case, the listener U or the like inputs a measured value by using the operating unit 62. Further, the interaural distance D of the listener U may be measured in advance by another device or the like. In this case, the measured value may be transmitted in advance from this another device to the processing device 210, or the processing device 210 may read this value each time.

The front time difference acquisition unit 213 acquires the front time difference ITD0 (S22). In this step, the front measurement is performed in the speaker placement shown in FIG. 6. The front time difference acquisition unit 213 calculates the front time difference ITD0 based on the first to third sound pickup signals obtained in the front measurement. Note that the front time difference ITD0 may be measured in advance by another device or the like. In this case, the measured value may be transmitted in advance from another device to the processing device 210, or the processing device 210 may read this value each time.

In the case where the interaural distance D and the front time difference ITD0 are measured in advance by another device, the switch unit 7 does not need to switch the connection to the third connection state. The switch unit 7 may be configured so as to switch between the first connection state and the second connection state.

The incident time difference calculation unit 215 calculates the incident time difference ITDθ (S23). As described above, the incident time difference calculation unit 215 calculates the incident time difference ITDθ by using the angle θ, the front time difference ITDθ and the interaural distance D.

Next, the sound pickup signal acquisition unit 212 acquires the first and second sound pickup signals by the characteristics measurement (S24). Then, the transfer characteristics generation unit 216 applies a delay time corresponding to the incident time difference ITDθ between the first and second sound pickup signals and generates the transfer characteristics (S25). The above-described process is performed repeatedly until it reaches the number of placements of speakers.

The transfer characteristics suitable for the individual listener U are thereby generated. Note that the order of the lateral measurement, the characteristics measurement, and the front measurement is not limited to the order shown in the flowchart of FIG. 9. Specifically, the order of processing of S21 to S24 is not particularly limited. For example, S21 may be performed after S22.

Note that the interaural time difference model for obtaining the interaural distance D and the front time difference ITD0 is not limited to the calculating formula shown in the expression (1). For example, the whole outline of the face of the listener U may be approximated by a circular arc. Alternatively, the whole outline of the face may be approximated by a straight line or a polynomial.

Although the measurement configuration where the stereo speaker 5 is placed ahead of the listener U is shown in FIG. 2, the number of speakers may be one. In this case, a speaker is placed ahead on the left of the listener U in the characteristics measurement of the Lch speaker, and this speaker is placed ahead on the right of the listener U in the characteristics measurement of the Rch speaker. This enables measurement with a monophonic input terminal.

Note that, in the front measurement shown in FIG. 5, the speaker 5C is preferably placed straight in front of the listener U. In other words, the center of the speaker 5C in the left-right direction preferably coincides with the center of the face of the listener U. If the speaker 5C is slightly displaced from the front of the listener U, measurement errors are contained in the front time difference ITD0. It is therefore important to place the speaker 5C in the direction at φ=0, which is straight in front. A method of checking whether the speaker 5C is placed straight in front of the listener U is described hereinafter with reference to FIG. 10.

Figure 10:
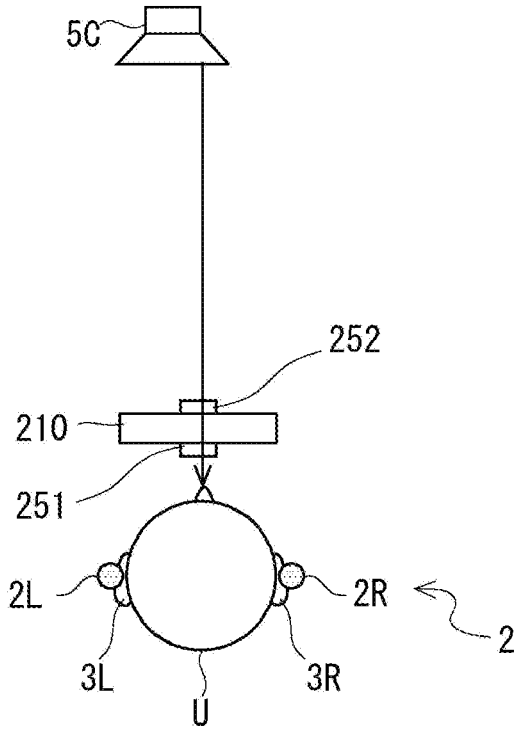
FIG. 10 is a schematic diagram illustrating processing for alignment during front measurement.

FIG. 10 shows a configuration for checking whether the speaker 5C is placed straight in front of the listener U, which is the position at φ=0. As shown in FIG. 10, the processing device 210 includes a first camera 251 and a second camera 252. For example, an in-camera and an out-camera mounted on a tablet PC or a smartphone may serve as the first camera 251 and the second camera 252, respectively.

The first camera 251 takes an image of the listener U, and the second camera 252 takes an image of the speaker 5C that is placed ahead of the listener U. Then, the processing device 210 performs image processing of the image taken by the first camera 251 and the image taken by the second camera 252, and thereby determines whether the speaker 5C is placed straight in front of the listener U. For example, by the image processing, the processing device 210 obtains the angle φ at which the speaker 5C is placed. The processing device 210 determines whether or not the speaker 5C is placed straight in front of the listener U depending on whether the angle φ is equal to or less than a threshold.

As shown in FIG. 10, when the speaker 5C is not placed straight in front of the listener U, the processing device 210 notifies the listener U that the speaker 5C is displaced in the left-right direction. For example, the processing device 210 displays the direction of displacement on a display screen. In this case, the listener U adjusts the relative position of the speaker 5C and the listener U.

When the angle φ of the speaker is equal to or less than the threshold, the processing device 210 enables the front measurement. For example, the processing device 210 displays a front measurement button on the display screen. The front measurement is initiated when the listener U touches this front measurement button. This allows more accurate measurement of the front time difference ITD0.

A part or the whole of the above-described processing may be executed by a computer program. The above-described program can be stored and provided to the computer using any type of non-transitory computer readable medium. The non-transitory computer readable medium includes any type of tangible storage medium. Examples of the non-transitory computer readable medium include magnetic storage media (such as floppy disks, magnetic tapes, hard disk drives, etc.), optical magnetic storage media (e.g. magneto-optical disks), CD-ROM (Read Only Memory), CD-R, CD-R/W, and semiconductor memories (such as mask ROM, PROM (Programmable ROM), EPROM (Erasable PROM), flash ROM, RAM (Random Access Memory), etc.). The program may be provided to a computer using any type of transitory computer readable medium. Examples of the transitory computer readable medium include electric signals, optical signals, and electromagnetic waves. The transitory computer readable medium can provide the program to a computer via a wired communication line such as an electric wire or optical fiber or a wireless communication line.

Although embodiments of the invention made by the present invention are described in the foregoing, the present invention is not restricted to the above-described embodiments, and various changes and modifications may be made without departing from the scope of the invention.

The present disclosure is applicable to a processing device that processes sound pickup signals.

What is claimed is:

1. A processing device for processing sound pickup signals obtained by picking up sound output from a sound source by left and right microphones worn on a listener, comprising:

a measurement signal generation unit configured to generate a measurement signal to be output from the sound source in order to perform characteristics measurement in a state where the sound source is placed in a direction at an angle θ from front of the listener;

a monophonic input terminal configured to receive input of sound pickup signals picked up by the left and right microphones;

a sound pickup signal acquisition unit configured to acquire the sound pickup signals picked up by the left and right microphones through the monophonic input terminal;

a switch unit configured to switch a connection state so that each of a first sound pickup signal picked up only by the left microphone and a second sound pickup signal picked up only by the right microphone is input to the monophonic input terminal;

an interaural distance acquisition unit configured to acquire an interaural distance of the listener;

a front time difference acquisition unit configured to acquire, as a front time difference, a difference in time of arrival from the sound source placed in front of the listener to the left and right microphones;

an incident time difference calculation unit configured to calculate an incident time difference based on the angle θ, the front time difference, and the interaural distance; and a transfer characteristics generation unit configured to calculate transfer characteristics from the sound source to the left and right microphones by applying a delay corresponding to the incident time difference to the first and second sound pickup signals acquired in the characteristics measurement, wherein the switch unit switches a connection state so that each of the first sound pickup signal picked up only by the left microphone, the second sound pickup signal picked up only by the right microphone, and a third sound pickup signal picked up by the left and right microphones is input to the monophonic input terminal, the sound pickup signal acquisition unit acquires each of the first to third sound pickup signals by front measurement performed in a state where the sound source is placed in front of the listener, and the front time difference acquisition unit calculates the front time difference based on the first to third sound pickup signals acquired in the front measurement, and further wherein the sound pickup signal acquisition unit acquires each of the first to third sound pickup signals by lateral measurement performed in a state where the sound source is placed in a lateral direction of the listener, and the interaural distance acquisition unit calculates the interaural distance based on the first to third sound pickup signals acquired in the lateral measurement.

2. The processing device according to claim 1, wherein the incident time difference calculation unit calculates an estimated time difference ITD by a following equation:

$$\varphi+\sin\varphi=2c\times ITD/D$$

where φ is an incident angle being the angle θ, D is the interaural distance, c is acoustic velocity, and ITD is an estimated time difference, and the incident time difference calculation unit calculates the incident time difference by adding the front time difference to the estimated time difference ITD.

3. A processing method in a processing device for processing sound pickup signals obtained by picking up sound output from a sound source by left and right microphones worn on a listener, where the processing device performs characteristics measurement by outputting a measurement signal to the sound source placed in a direction at an angle θ from front of the listener, the processing device has a monophonic input terminal, a switch unit is placed between the monophonic input terminal and the left and right microphones, and the switch unit switches input to the monophonic input terminal so that each of a first sound pickup signal picked up only by the left microphone and a second sound pickup signal picked up only by the right microphone is input to the monophonic input terminal, the processing method comprising:

acquiring an interaural distance of the listener;

acquiring, as a front time difference, a difference in time of arrival from the sound source placed in front of the listener to the left and right microphones;

calculating an incident time difference based on the angle θ, the front time difference, and the interaural distance; and calculating transfer characteristics from the sound source to the left and right microphones by applying a delay corresponding to the incident time difference to the first and second sound pickup signals acquired in the characteristics measurement, wherein the switch unit switches a connection state so that each of the first sound pickup signal picked up only by the left microphone, the second sound pickup signal picked up only by the right microphone, and a third sound pickup signal picked up by the left and right microphones is input to the monophonic input terminal, each of the first to third sound pickup signals is acquired by front measurement performed in a state where the sound source is placed in front of the listener, and the front time difference is calculated based on the first to third sound pickup signals acquired in the front measurement, and further wherein each of the first to third sound pickup signals is acquired by lateral measurement performed in a state where the sound source is placed in a lateral direction of the listener, and the interaural distance is calculated based on the first to third sound pickup signals acquired in the lateral measurement.

4. A non-transitory computer readable medium storing a program causing a computer to execute a processing method for processing sound pickup signals obtained by picking up sound by left and right microphones, where the computer performs characteristics measurement by outputting a measurement signal to the sound source placed in a direction at an angle θ from front of the listener, the computer has a monophonic input terminal, a switch unit is placed between the monophonic input terminal and the left and right microphones, and the switch unit switches input to the monophonic input terminal so that each of a first sound pickup signal picked up only by the left microphone and a second sound pickup signal picked up only by the right microphone is input to the monophonic input terminal, the processing method comprising:

acquiring an interaural distance of the listener;

acquiring, as a front time difference, a difference in time of arrival from the sound source placed in front of the listener to the left and right microphones;

calculating an incident time difference based on the angle θ, the front time difference, and the interaural distance; and calculating transfer characteristics from the sound source to the left and right microphones by applying a delay corresponding to the incident time difference to the first and second sound pickup signals acquired in the characteristics measurement, wherein the switch unit switches a connection state so that each of the first sound pickup signal picked up only by the left microphone, the second sound pickup signal picked up only by the right microphone, and a third sound pickup signal picked up by the left and right microphones is input to the monophonic input terminal, each of the first to third sound pickup signals is acquired by front measurement performed in a state where the sound source is placed in front of the listener, and the front time difference is calculated based on the first to third sound pickup signals acquired in the front measurement, and further wherein each of the first to third sound pickup signals is acquired by lateral measurement performed in a state where the sound source is placed in a lateral direction of the listener, and the interaural distance is calculated based on the first to third sound pickup signals acquired in the lateral measurement.

* * * * *